United States Patent [19]

Kan

[11] 3,953,009

[45] Apr. 27, 1976

[54] METALLURGICAL VESSEL

[75] Inventor: Yih-Renn Kan, Troy, Mich.

[73] Assignee: General Motors Corporation, Detroit, Mich.

[22] Filed: June 19, 1975

[21] Appl. No.: 588,378

[52] U.S. Cl. ..... 266/283; 52/249; 52/611

[51] Int. Cl.[2] ..... F27B 7/28

[58] Field of Search ..... 13/35; 52/249, 574, 52/611; 110/1 A, 1 B; 266/39, 43; 432/119

[56] References Cited

UNITED STATES PATENTS

| | | | |
|---|---|---|---|
| 1,553,004 | 9/1925 | Packard | 110/1 A |
| 1,784,586 | 12/1930 | Fairchild | 110/1 A |
| 2,727,737 | 12/1955 | Dole | 266/43 X |

*Primary Examiner*—Gerald A. Dost
*Attorney, Agent, or Firm*—Jack I. Pulley

[57] ABSTRACT

In accordance with a preferred embodiment of this invention, the useful life of a refractory lining of a substantially cylindrical metallurgical vessel is significantly increased by the use of T-shaped bricks disposed on their face surfaces in an intermeshing relationship wherein some of the adjoining surfaces of adjacent bricks are coincident with a radius of the vessel and the other adjoining surfaces are concentric therewith. This invention extends the life of the vessel by delaying the initial failure of the mortar and then delaying leakage of the molten metal through the refractory lining once the mortar has failed.

3 Claims, 4 Drawing Figures

METALLURGICAL VESSEL

FIELD OF THE INVENTION

This invention relates to metallurgical vessels such as induction furnaces and to the shape and arrangement of refractory bricks used in the refractory linings thereof.

BACKGROUND OF THE INVENTION

Presently, most durable metallurgical vessel designs employ a two-layer concept wherein the inner layer, the refractory lining, provides heat resistance and the outer layer, or shell, provides the physical strength. The inner layer consists of horizontal courses of bricks bonded together with a suitable refractory mortar; the courses are stacked against the inner surface of the outer layer. Since the bricks are more durable than the mortar, lining failure typically occurs in the mortared joints. This mode of failure must be delayed if there is to be a significant increase in the life of metallurgical vessels.

In the widely used prior art wedge-shaped refractory brick design, the joints between the bricks within one course are radially oriented straight lines. Because of the hoop stress generated in the lining, by the static pressure of the molten metal, the mortar in these joints is subjected to a tensile stress. However, the tensile strength of the mortar is low, only about ¼ of its shear strength and the applied tensile stress markedly accelerates the deterioration of the mortar. Thus, in this configuration the most common failure occurs as a section of mortar in a joint between two bricks in the same course deteriorates and the molten metal is able to leak through the refractory lining to the outer shell. At this point the entire refractory lining must be replaced even though the bricks themselves may be intact and in relatively good condition.

OBJECTS OF THE INVENTION

It is an object of this invention to provide a metallurgical vessel including a refractory lining having at least one course of T-shaped bricks bonded together by a refractory mortar in an intermeshing relationship wherein the shape of the bricks and the intermeshing relationship distribute the stresses in the lining so as to extend the life of the vessel by delaying the deterioration of the mortar; the shape of the brick and the intermeshing relationship also distributes the forces acting on the lining so that potential leakage paths between the bricks tend to be sealed once the mortar has failed.

It is a further object of this invention to provide a metallurgical vessel such as a typical substantially cylindrical induction furnace having an improved refractory lining made of specially shaped refractory bricks, wherein each brick has a head portion and a base portion arranged in a T-shaped configuration. The subject bricks are disposed on their face surfaces in the refractory lining such that adjacent bricks are oppositely oriented in the radial direction; that is, as one brick presents the outer side surface of its head portion to the center of the vessel, the two bricks on either side and in the same course, present the outer side surface of their base portion to the center of the vessel. In this arrangement, the mortared joints between the under surfaces of the head portions of adjacent bricks are circumferentially oriented. Therefore, the hoop stress in the lining causes the mortar in these joints to be loaded primarily in shear.

SUMMARY OF THE INVENTION

In accordance with a preferred embodiment of this invention, a substantially cylindrical induction furnace, having a refractory lining disposed within and against an outer supporting shell is formed; the lining is formed from stacked horizontal courses of T-shaped bricks. In each course, the bricks are laid on their face surfaces in an intermeshing head-to-base relationship; thus, adjacent bricks in the same course are oppositely oriented in the radial direction. In this configuration, the mortared joint between the side surface of the head of one brick and the adjoining side surface of the base of the adjacent brick in the same course is coincident with a radius of the vessel and the mortared joint between the adjoining under surfaces of the heads of adjacent bricks are coincident with a cylindrical surface that is concentric with the cylindrical vessel itself. Therefore, the shape of the brick and the intermeshing relationship combine to provide each course with a uniform radial thickness and smooth internal and external surfaces as shown in FIG. 1.

In the subject cylindrical induction furnace, the inner refractory lining is subjected to the static pressure of the molten metal and also the restraining pressure exerted by the outer shell. During the heating and cooling of the vessel there will of course be other forces acting on the refractory lining; however, once at operating temperature and filled with molten metal, it is believed that the static pressure will be most important in analyzing the stresses on the lining.

The static pressure of the molten metal in the vessel will cause circumferential (i.e. hoop) and longitudinal stresses in the refractory lining; the circumferential stress will be about twice the longitudinal stress and will cause a tensile stress in the mortar in any joint, wherein the adjoining surfaces are coincident or near so with a radius of the vessel. In the subject design, these would be the surfaces between the head of one T-shaped brick and the base of the adjacent T-shaped brick. However, the mortar in the joint formed by the adjoining under surfaces of the heads of adjacent bricks, which joints are concentric with the vessel, is loaded primarily in shear. The refractory lining structure which permits this type of loading is a significant improvement over the prior art because the shear strength of a refractory mortar is typically about 4 times greater than its tensile strength. Therefore, the use of the subject T-shaped bricks in the disclosed configuration will provide a significant increase in the useful life of the mortar.

In addition, the subject T-shaped brick and intermeshing relationship will also extend the life of the lining beyond the point at which the mortar deteriorates and is no longer able to withstand the circumferential stresses in the refractory lining. In this situation, the pressure of the molten metal will force the adjoining under surfaces between the head portions of adjacent bricks together and tend to seal the potential leakage path for the molten metal. The subject shape of the bricks and their arrangement distribute the forces in this manner and will thereby extend the life of the lining beyond that point at which the mortar fails.

These and other advantages of the subject invention will be more clearly understood in view of a detailed description thereof, in which reference will be made to the drawings.

DETAILED DESCRIPTION OF THE INVENTION

Figure 1:
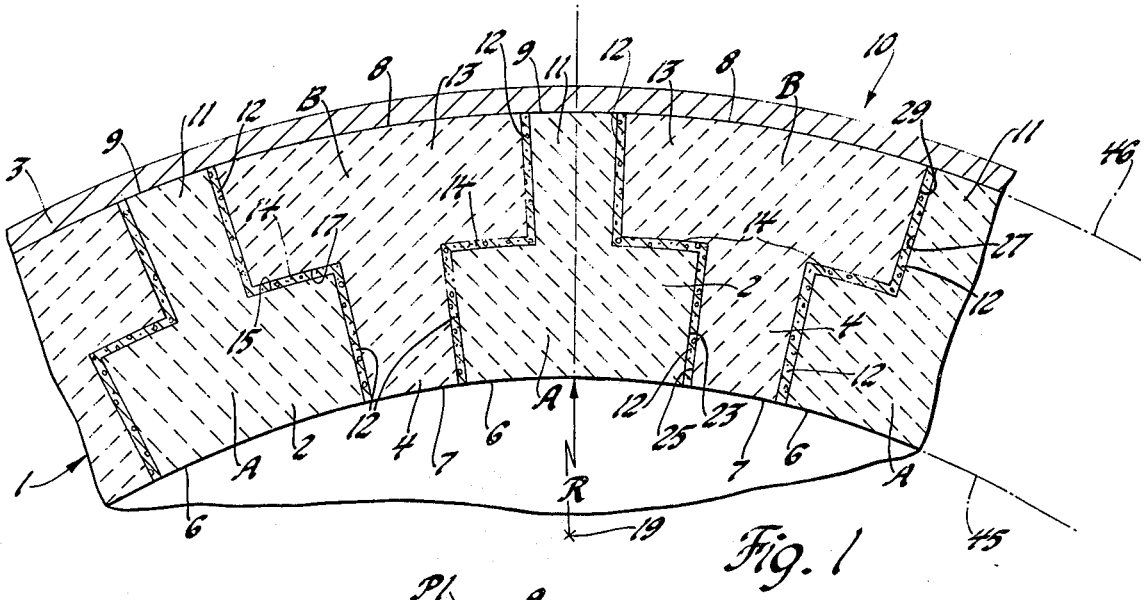
FIG. 1 is a plan view of part of one course of the subject bricks in a refractory lining of a portion of a cylindrical vessel suitable for holding molten iron and the like, wherein this course the subject T-shaped bricks are arranged in the presecribed intermeshing relationship.

FIG. 1 is a plan view of a course of bricks 1 constructed against the outer cylindrical steel shell 3 of a molten metal containing vessel 10 in accordance with this invention. In this embodiment, two types of T-shaped bricks are used in an intermeshing relationship within a given course. Type A bricks are designed so that they will lie with their head portions 2 facing the center of the vessel 10; and the B bricks are designed so that their base portions 4 face the center of the vessels 10.

To form relatively smooth inner and outer surfaces of the refractory lining, the top surfaces 6 of the head portions 2 of type A bricks are concave and are coincident with a circle 45 which is concentric to the vessel 10. Likewise, the bottom surfaces 7 of the base portions 4 of type B bricks are also concave and coincident with circle 45. Similarly, the bottom surfaces 9 of the base portions 11 of type A bricks are convex and coincident with circle 46 which is also concentric with vessel 10. Likewise, the top surfaces 8 of the head portions 13 of type B bricks are also convex and coincident with circle 46. However, the degree of smoothness of either the external or the internal surface is not critical to the subject invention.

A critical feature of the subject invention is the mortared joint 14 between the under surface of a head portion of a given brick and the adjoining under surface of the head portion of an adjacent brick. More specifically, and referring to FIG. 1, under surface 15 of the head portion 2 of a type A brick is mortared to under surface 17 of the adjoining head portion of a type B brick; both surfaces 15 and 17 should be substantially coincident with circles which are concentric to vessel 10.

In addition, it is noted that both type A and type B bricks are symmetrical about a radius of the vessel R passing through the center of the brick. This is preferred since there is no net moment acting on a brick about an axis parallel to the axis 19 of vessel 10.

Finally, in a preferred embodiment, the side surfaces 23 on the head portions 2 of type A bricks, which are mortared to side surfaces 25 on the base portions 4 of type B bricks, are coincident with a radius of vessel 10, as are side surfaces 25. In a similar manner, side surfaces 27 of the base portion 11 of type A bricks, and adjoining surfaces 29 of the head portions 13 of type B bricks, are also coincident with a radius of vessel 10. These head-to-base mortared joints are designated as 12 in FIG. 1. However, in a suitable embodiment, the bricks may be constructed such that the adjoining surfaces between the head portion of one brick and the base portion of an adjoining brick, are at an angle with the radius of vessel 10, to provide a back-arch or front-arch construction under the conditions that (1) the aforementioned symmetry is substantially maintained, and (2) the substantial uniformity of the mortar layer thickness is also maintained.

The fact that two different types of bricks are needed is inherent in the design of the lining which requires, (a) concave inner surfaces 6 and convex outer surfaces 8, (b) that the head-to-base mortared joints 12 are coincident with a radius of the vessel, (c) that the head-to-head mortared joints 14 lie on a circle concentric with the vessel 10. In this preferred embodiment the width 54 in FIG. 3 of the base portion 11 of a brick is equal to the width 52 of the head portion 2, of that brick; however, this is not a critical dimension and may vary considerably as long as the strength of the brick is not severely affected by variations thereof.

Figure 2:
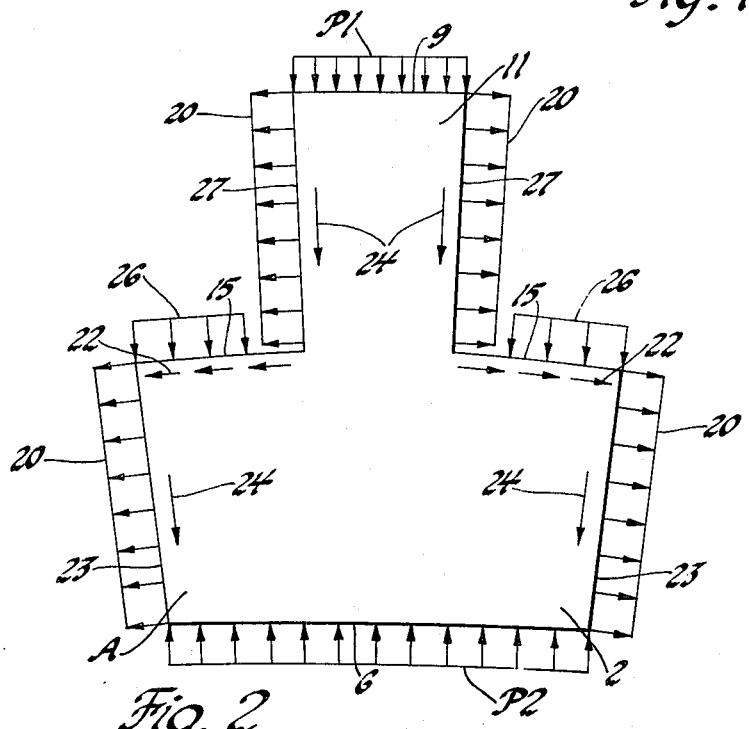
FIG. 2 is a free body diagram of a single T-shaped brick which shows the various forces acting on the brick and the mortar in the adjacent joints when used in the subject application.

FIG. 2 is a free body diagram showing the forces acting on a single T-shape brick and on the mortar in the joints adjacent thereto when the vessel contains molten metal. This particular drawing is of an A-type brick; however, the forces on the B-type would be the same except the static force of the molten metal acts on its base and the force exerted by the shell acts on its head. As shown in this diagram, the outer shell and the molten metal exert relatively uniform pressures against the convex surface 9 of base portion 11 and the concave surface 6 of head portion 2; these pressures are labeled P1 and P2 respectively. The circumferential or hoop stress in the lining is a tensile stress as indicated by arrows 20 in the mortar in the head-to-base joints 12 and a shear stress as indicated by arrows 22 in the mortar in the head-to-head joint 14.

It is noted that to counteract the difference in the total forces acting in the radial direction on the top and bottom surfaces, 6 and 9, of the brick, there will be a shear stress as indicated by arrows 24 on the mortar in the radially oriented interfaces, and a force as indicated by arrows 26 acting on surfaces 15 which form the head-to-head joints 14. However, once the mortar fails, the only forces available to counteract the difference in the forces acting on the top and bottom surfaces 6 and 9 as indicated by arrows P1 and P2 are those forces as indicated by arrows 26 acting on the head-to-head joints 14. These forces will tend to close the potential leakage path through these circumferentially oriented joints and thereby delay the failure of the lining beyond the failure of the mortar.

Figure 3:
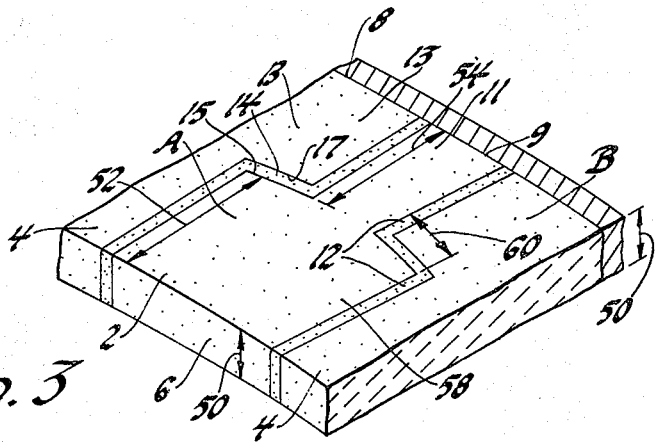
FIG. 3 is a perspective view of a brick as it is disposed in a typical course.

In the subject intermeshing relationship by the adjacent T-shaped bricks which is shown in perspective in FIG. 3, the mortared joint formed by the adjoining under surfaces 17 and 15 of the head portions of adjacent bricks is located approximately at the mid point of the refractory lining. That is, the width 52 of the head portion of one brick is about equal to the width 54 of the base portion of that brick. In addition, the bricks have a substantially uniform thickness 50, and the upper face of the brick 58 is parallel to the bottom face of the brick which is not shown in this figure. In a preferred embodiment as shown in FIG. 3, the head portion 2 or 13 of a brick extends from each side of the base portion 4 or 11 a distance 60 which is about the same distance 54 that the base portion 4 or 11 extends from the head portion 2 or 13. However, this relationship is not critical and may vary considerably as long as the brick is not substantially weakened thereby.

Figure 4:
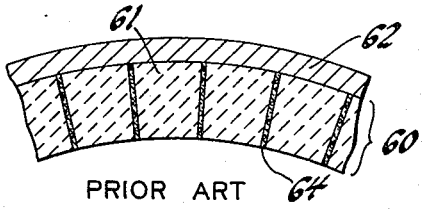
FIG. 4 shows a refractory lining formed of the conventional prior art wedge-shaped bricks.

FIG. 4 illustrates the conventional wedge-shaped brick design used in most cylindrical metallurgical vessels today. In this figure, the refractory lining 60 is disposed against a rigid outer shell 62. The wedge-shaped bricks 61 are separated by a layer of mortar 64 having a uniform thickness and which is coincident with a radius of the vessel. In this refractory design the mortar is loaded primarily in tension due to the hoop stress caused by the pressure of the molten metal, and failure typically occurs in the mortar joints. It appears that the mortar, which is loaded primarily in tension, deteriorates and as this occurs the molten metal is able to leak through the space left by the deteriorated mortar and reach the outer shell 62, and to thereby cause a premature failure of the lining.

In accordance with the practice of this invention, the shape of the refractory bricks and their intermeshing configuration distribute the forces and stresses acting on a refractory lining so as to prolong the life of the mortar by loading at least some of the mortar portion of the lining primarily in shear and in addition to prolong the useful life of the lining once the mortar has failed by forcibly closing potential leakage paths through the brick-to-brick joints.

To accomplish this it was first necessary to analyze the relative strengths and weaknesses of the bricks and the mortar. In general, the elastic modulus and strength of refractory bricks are much higher than those of the bonding refractory mortar. For example, a typical brick will have a stiffness ratio of $7.5 \times 10^6$ psi while the typical mortar material will have a stiffness of only $3 \times 10^6$ psi. Furthermore, the bricks will have a rupture strength of almost four times that of the mortar material, a typical brick will have a rupture strength of about 2,500 psi while the mortar has a rupture strength of less than 500 psi at the operating temperature of about 1,700° F. From this it is obvious that under high circumferential stress, the most common failure mode for a conventional refractory lining should be at the bonding mortar. The formation of vertical metal fins between the prior art wedge shaped bricks in the refractory lining of a typical upright cylindrical vessel are the results of this type of failure.

In addition, it is known that refractory mortar materials are brittle and therefore have a much higher shear strength than tensile strength. This explains why, in the conventional wedge-shape brick lining, the typical leakage path is vertical (if the vessel is upright), that is, parallel to the axis of the vessel rather than perpendicular thereto. The mortar in the joints which are parallel to the longitudinal axis of the vessel is under a greater tensile stress caused by the circumferential stress in the lining, than the mortar which is perpendicular to the axis of the vessel, that is, between courses of bricks.

In designing a more durable refractory lining, it was also necessary to understand the type of stresses acting on the lining when it is in operation. In this analysis, the vessel may be viewed as a thin walled vessel. Therefore, the static forces exerted against the lining by the molten iron or the like will generate a circumferential and a longitudinal stress in the lining; these are tensile stresses. However, since the circumferential stress is about twice the longitudinal stress, the former will be the primary factor to be considered in the design, especially in view of the relative weakness of the mortar when subjected to tensile stresses. In addition, the pressure from point to point along both the external and internal surfaces of the lining will be relatively uniform.

For this application the T-shaped brick was designed; this brick, as shown in FIG. 1, is disposed on its face in an intermeshing relationship so that adjacent bricks are oppositely oriented in the radial direction. It is to be noted that each brick touches both the inner and outer surface of the lining and because of the intermeshing relationship within a course, the course has a uniform radial thickness and relatively smooth surfaces also. In addition, the shape of the bricks is controlled so that the mortar which bonds adjacent bricks together have a relatively uniform thickness throughout the brick-to-brick joint.

In this configuration, the head-to-head joint 14, between the under surfaces of the head portions of two adjacent bricks falls on a circle which is concentric with the vessel. Therefore, the circumferential stress within the refractory lining imposes a shear stress on the portion of mortar in the head-to-head joint 14. Thus, this design takes advantage of the greater shear strength of the mortar at this surface, and thereby extends the life of the mortar.

As the mortar fails, the lining is no longer able to support a circumferential tensile stress. In the normal wedge-shaped brick design the lining would quickly fail as the molten metal would leak through the joints within a given course to the outer shell. However, the subject T-shaped brick and the intermeshing relationship translates a portion of the radial forces P1 and P2 acting on the internal and external surfaces of the lining to the head-to-head interfaces 14. This force seals the leakage path through these head-to-head joints and thereby extends the life of the lining beyond the point at which the mortar has failed.

This is accomplished in the subject design by the fact that the surface area which a given brick presents to the internal surface of the lining does not equal the surface area which that brick presents to the external surface. Therefore, because of the relatively uniform pressure on each surface of the lining, the total force, (i.e. the pressure times the surface area over which that pressure acts) on the internal surface does not equal the total force acting on that brick on the external surface. Therefore, a portion of the force is translated from one brick to an adjacent brick at the head-to-head joint 14 to maintain static equilibrium. Because of the shape of the bricks and their arrangement, once the mortar has failed, the only forces available to counteract this net imbalance are those acting on the surfaces 15 and 17 which form the head-to-head joint 14 because all other brick-to-brick joints within the lining are coincident with a radius of the vessel and are therefore incapable of translating radial forces from brick to brick once the mortar has lost its integrity.

In addition, it is to be emphasized that as the mortar fails, there is no net moment acting on a brick about any axis which is parallel to the longitudinal axis of the vessel. This is desirable since such a moment would tend to cause the brick to rotate which, in turn, would tend to open a leakage path for the molten metal to reach the external shell. From the above, it is evident that the subject design would extend the life of the refractory lining beyond that point at which the mortar in the radial joints 12 has failed.

It is to be noted that the preferred embodiment of the subject invention necessitates the use of two types of bricks: type A having a concave head facing the center of the vessel and a convex base facing the cylindrical shell and type B having a convex head lying against the shell and a convex base facing the center of the vessel. It is also noted that the head-to-head joint 14 is preferably located near the center of the refractory lining, however, this is not necessary. This interface may be shifted by varying the relative thickness of the heads of adjacent bricks.

In the design and operation of the subject metallurgical vessel, it is also to be emphasized that the outer layer provides physical support for the refractory lining and furthermore, once the lining has failed and the molten metal has reached the support layer, the vessel must be shut down immediately. Therefore, the outer shell need not be a continuous surface and may, in fact, have holes or even be a screen as long as it provides adequate physical support for the lining.

While this invention has been described in terms of certain specific embodiments, it will be appreciated that other forms thereof could readily be adapted by one skilled in the art. Therefore, the scope of this invention is not to be limited by the specific embodiment disclosed but only by the following claims.

I claim:

1. A vessel for holding molten iron and the like, the vessel comprising, a. an external hollow substantially cylindrical support member; and b. a refractory lining disposed against the inner surface of the support member comprising at least one course of refractory bricks, the bricks having a head portion and a base portion arranged in a T-shaped configuration and the bricks being disposed in the course on their face surfaces in an intermeshing relationship where each brick is separated from, and bonded to, each adjacent brick by a layer of refractory mortar having a relatively uniform thickness and where adjacent bricks are oppositely oriented in the radial direction to define circumferentially oriented, registered and joining under surfaces between the head portions of adjacent bricks, the relationship also providing the course with a uniform radial thickness.

2. A vessel for holding molten metal and the like, the vessel comprising, a. an external substantially cylindrical supporting shell; and b. a refractory lining disposed against the inner surface of the shell wherein the molten metal exerts a static pressure on the inner surface of the lining which is countered by pressure exerted by the external shell thereby creating relatively uniform pressures from point to point on both the inner and external surfaces of the lining, the lining comprising at least one course of refractory bricks, each brick having a uniform thickness and a head portion and a base portion arranged in a T-shaped configuration, wherein the course adjacent bricks are separated and bonded together by a layer of refractory mortar of substantially uniform thickness which mortar is inherently weaker than the bricks, the bricks being disposed in the course on their face surfaces in an intermeshing relationship wherein adjacent bricks are oppositely oriented in the radial direction to define circumferentially oriented registered joining under surfaces between the head portions of adjacent bricks, the T-shape configuration and the intermeshing relationship providing the course with a uniform radial thickness and substantially smooth internal and external surfaces and where in the refractory lining the total static force on the inner surface of a specific brick does not equal the total force on the external surface of that specific brick because of the difference in surface area presented to the internal and external surfaces of the lining by that specific brick and where in said intermeshing relationship the joining side surfaces between the head of one brick and the base portion of the adjacent bricks are coincident with a radius of the vessel thereby allowing, as the weaker mortar fails, radially oriented compressive forces on the joining under surfaces of the head portions of adjacent bricks to offset the difference in the forces acting on the internal and external surfaces of the bricks and thereby sealing a potential leakage path for the molten metal and thus delaying leaks in the lining once the mortar has failed.

3. A metallurgical vessel comprising:

a. an external substantially cylindrical support layer; and b. a refractory lining disposed against the inner surface of the support layer, said lining being formed from at least one course of mortared refractory bricks, each of said bricks having a base portion and a head portion arranged in a T-shaped configuration, the bricks being disposed on their face surfaces in an intermeshing relationship in which adjacent bricks are oppositely oriented in the radial direction so that as one brick presents its head portion to the center of the vessel, both adjacent bricks within the course present their base portions to the center of the vessel, which intermeshing relationship provides said lining with a relatively uniform radial thickness, all side surfaces of each brick being substantially perpendicular to its face surfaces, and the radial width of the base portion being substantially equal to the radial width of the head portion, and where in each brick the side surfaces of the base portion which in a course of the refractory lining would abut the side surfaces of the head portion of the adjacent bricks are radially oriented, and where in each brick the side surfaces of the head portion, which in a course of the refractory lining would abut the side surfaces of the base portion of the adjacent bricks are radially oriented and where in each brick the outer side surfaces of the head portion and the bottom portion which do not abut adjacent bricks are circumferentially oriented and where in each brick each surface of the head portion which abuts a surface of the head portion of the adjacent brick is circumferentially oriented.

* * * * *